US010443224B1

(12) United States Patent
Sykes

(10) Patent No.: US 10,443,224 B1
(45) Date of Patent: Oct. 15, 2019

(54) MULTI-PART SUMP PUMP BUCKET

(71) Applicant: William G. Sykes, Virginia Beach, VA (US)

(72) Inventor: William G. Sykes, Virginia Beach, VA (US)

( * ) Notice: Subject to any disclaimer, the term of this patent is extended or adjusted under 35 U.S.C. 154(b) by 0 days.

(21) Appl. No.: 16/114,792

(22) Filed: Aug. 28, 2018

(51) Int. Cl.

| | |
|---|---|
| ***E03F 5/22*** | (2006.01) |
| ***E03F 5/14*** | (2006.01) |
| ***E03F 5/02*** | (2006.01) |
| ***E03F 7/00*** | (2006.01) |
| *F04D 29/40* | (2006.01) |

(52) U.S. Cl.
CPC ..... *E03F 5/22* (2013.01); *E03F 5/024* (2013.01); *E03F 5/14* (2013.01); *E03F 7/00* (2013.01); *F04D 29/406* (2013.01); *Y10T 137/6991* (2015.04)

(58) Field of Classification Search
CPC ..... E03F 5/024; E03F 5/0404; E03F 5/0407; E03F 5/14; E03F 5/22; E03F 7/00; F04D 29/406; B01D 29/33; B01D 35/02; B01D 35/26; B65D 7/06; B65D 9/06; B65D 11/10; B65D 11/105; B65D 11/14; B65D 11/18; B65D 11/1866; B65D 11/188; B65D 11/24; B65D 15/22; Y10T 137/6991
USPC ..... 137/343, 356, 357, 362, 363, 364; 405/36; 210/170.01, 416.1, 459; 220/4.21, 4.24, 4.28, 4.33, 601, 661, 670, 220/671, 676, 692, 693
See application file for complete search history.

(56) References Cited

U.S. PATENT DOCUMENTS

| | | | | |
|---|---|---|---|---|
| 3,595,398 | A * | 7/1971 | Cook | B01D 35/30 210/232 |
| 5,381,915 | A * | 1/1995 | Yardley | B65D 19/16 206/600 |
| 5,591,331 | A * | 1/1997 | Nurse, Jr. | B01D 29/035 210/232 |
| 5,759,393 | A * | 6/1998 | Nurse, Jr. | B01D 29/035 210/232 |
| 5,795,472 | A * | 8/1998 | Nurse, Jr. | B01D 29/035 210/232 |
| 2006/0048756 | A1* | 3/2006 | Ikeya | B01D 29/111 123/509 |
| 2008/0078142 | A1* | 4/2008 | Andras | E02D 31/02 52/741.3 |
| 2008/0155929 | A1* | 7/2008 | Herron | E04C 1/395 52/582.1 |
| 2009/0183785 | A1* | 7/2009 | Cole | E03F 5/22 137/363 |
| 2015/0060339 | A1* | 3/2015 | Kasai | B23H 1/10 210/87 |

* cited by examiner

*Primary Examiner* — Kevin F Murphy
*Assistant Examiner* — Jonathan J Waddy
(74) *Attorney, Agent, or Firm* — William G. Sykes

(57) ABSTRACT

A multi-part sump pump bucket for a sump pump installation is shown and described. The multi-part sump pump bucket may comprise at least two complementing sections which may be united to form an open receptacle, and a cap installable over the complementing sections after assembly of the latter. The open receptacle may include a raised section of floor for supporting the sump pump up off the floor, to assist with liquid pickup. The complementing sections may include flanges bearing holes for receiving fasteners, to assist with assembly of the receptacle. The cap may have openings for a liquid discharge conduit and electrical circuitry.

4 Claims, 2 Drawing Sheets

MULTI-PART SUMP PUMP BUCKET

BACKGROUND OF THE INVENTION

Houses and other structures frequently have basements, crawl spaces, stairwells, and other places which collect water or other liquids, and which are restricted as to access or have limited maneuvering space. One solution to the problem of accumulation of water is to install a sump pump at the affected location. A sump pump installation typically requires a bucket and a sump pump occupying the bucket. The bucket may be provided with a cover for safety considerations and may have openings to pass a liquid discharge conduit and an electrical circuit to serve the sump pump motor.

Because of the spatial constrains on many places which would otherwise be desirable for installing sump pumps, it is possible that the sump pump bucket is not easily transported to the desired location and installed. Some installers have resorted to cutting a sump pump bucket into two parts, positioning the parts in the desired location, and fastening the parts together. Reassembly of the sump pump bucket is not necessarily quickly performed.

There exists a need for a readily reassembled sump pump bucket for sump pump installations.

SUMMARY OF THE INVENTION

The present invention provides a multi-part sump pump bucket which is made up from readily small, easily transportable and maneuverable parts, and is readily assembled. To this end, the multi-part sump pump bucket may comprise at least two receptacle portions which when assembled form a receptacle having a floor and side wall(s), and a removable cap readily installed on the receptacle.

The receptacle includes accommodation for fastener to promote ready assembly of the receptacle. The cap has at least one opening for passing a discharge conduit and electrical circuitry.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
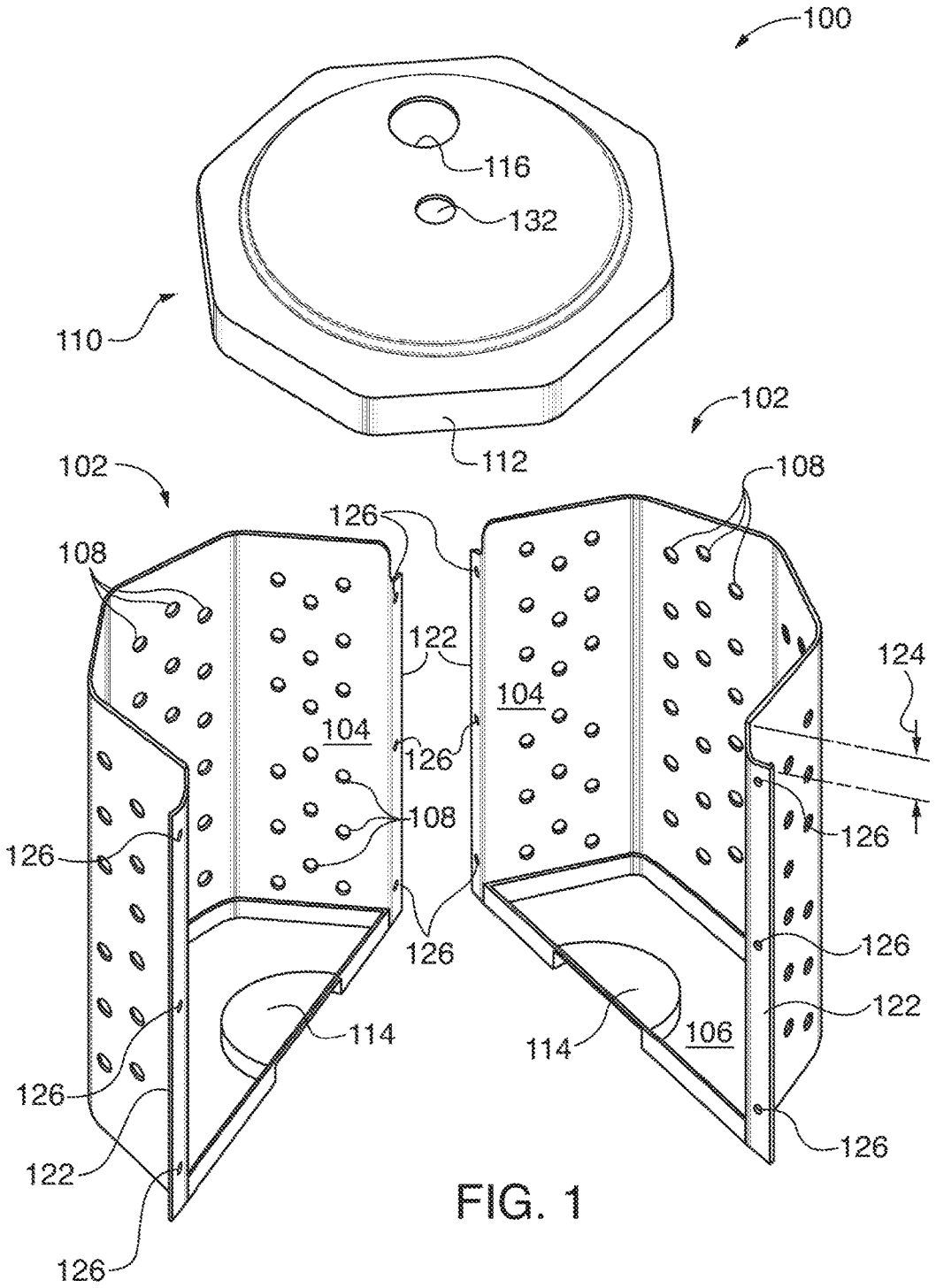
FIG. 1 is an exploded view of a multi-part sump pump bucket, according to at least one aspect of the disclosure.

Referring first to FIGS. 1-4, but with particular reference to FIG. 1, according to at least one aspect of the invention, there is shown a multi-part sump pump bucket 100 for receiving a sump pump (not shown). Multi-part sump pump bucket 100 may comprise at least two complementing receptacle components 102 matable to one another to form a receptacle including a side wall 104 and a floor 106. Sidewall 104 is called out in FIGS. 2-4. The at least two complementing receptacle components 102 may include a fastening arrangement for assembling the at least two complementing receptacle components 102 into the receptacle. At least side wall 104 of the receptacle has at least one aperture 108 to enable ingress of liquid in the vicinity of the multi-part sump pump bucket 100 to enter the receptacle. Floor 106 of the receptacle includes a raised portion 114 for spacing the sump pump up off a portion of floor 106, to facilitate water pickup by the sump pump.

Multi-part sump pump bucket 100 may also comprise a cap 110 having a short, downwardly projecting skirt 112 configured to fit closely to the receptacle after the receptacle has been assembled from the at least two complementing receptacle components 102. Cap 110 may also comprise at least one opening 116 extending entirely therethrough for enabling a liquid discharge conduit 10 (FIG. 3) to extend from a sump pump in the receptacle to an exterior of multi-part sump pump bucket 100.

As seen in FIG. 1, the multi-part sump pump bucket includes a three part housing when not assembled.

It should be noted at this point that orientational terms such as up, raised, downwardly, and top refer to the subject drawing as viewed by an observer. The drawing figures depict their subject matter in orientations of normal use, which could obviously change with changes in posture and position of the novel multi-part sump pump bucket 100. Therefore, orientational terms must be understood to provide semantic basis for purposes of description, and do not limit the invention or its component parts in any particular way.

In one embodiment of multi-part sump pump bucket 100, raised portion 114 of floor 106 is centered in floor 106 with respect to side wall 104.

Figure 2:
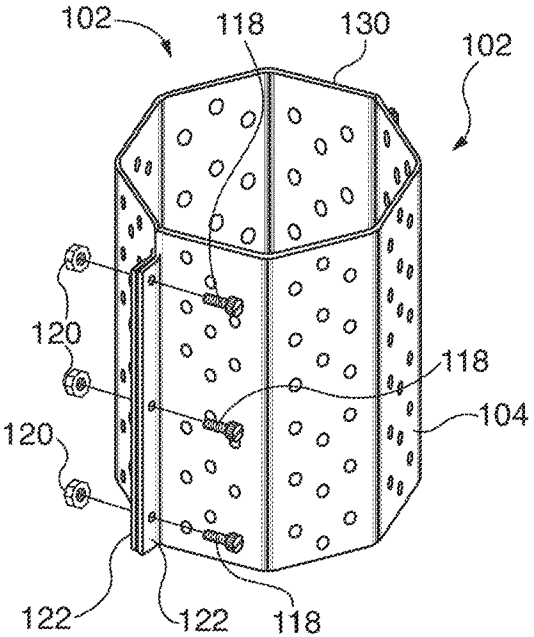
FIG. 2 is a partially exploded, perspective view of side walls of the multi-part sump pump bucket of FIG. 1.

Referring particularly to FIG. 2, the at least two complementing receptacle components 102 may be identical to one another and are configured to be matable to one another by at least one fastener when at least two of the complementing receptacle components 102 are placed into abutment with one another. The fastener may comprise bolt 118 and a nut 120. Bolt 118 may have a head bearing a slot for receiving a screwdriver and ridges on the side to facilitate finger grip of bolt 118. The fastening arrangement may comprise at least one flange 122 on each one of the at least two complementing receptacle components 102, associated holes 126, nuts 120, and bolts 118. Each flange 122 may terminate a distance 124 (FIG. 1) from a top of side wall 104, to avoid interference with cap 110 when cap 110 is installed on side wall 104. Each flange 122 may include at least one hole 126 for receiving a fastener (e.g., bolt 118).

Figure 4:
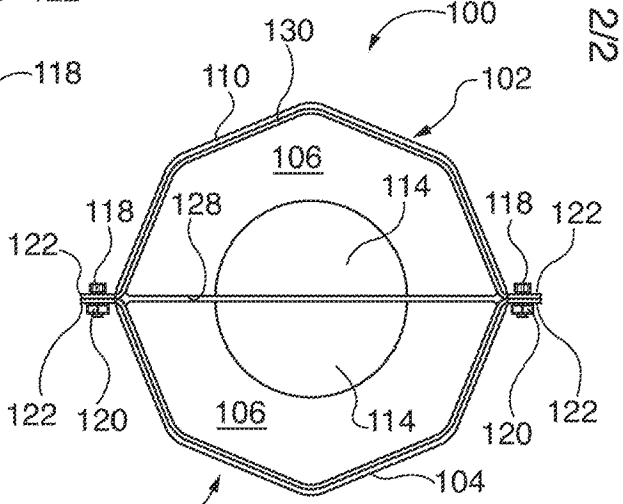
FIG. 4 is a bottom plan view of the multi-part sump pump bucket of FIG. 1.

Referring specifically to FIG. 4, each one of the at least two complementing receptacle components 102 is configured to leave an uncovered gap 128 between adjacent complementing receptacle components 102 at floor 106 when complementing receptacle components 102 are assembled to form the receptacle. Thus, liquid can enter the receptacle from there beneath as well as through the at least one aperture 108 of side wall 104.

The receptacle may have a polygonal perimeter 130 when assembled and viewed in plan (FIG. 4). The polygonal perimeter 130 may be octagonal when assembled and viewed in plan.

Figure 3:
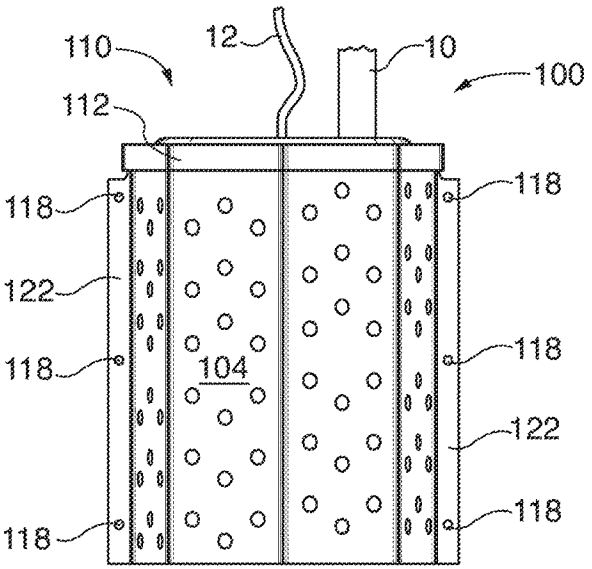
FIG. 3 is an environmental side view of the multi-part sump pump bucket of FIG. 1.

The at least one opening 116 in cap 110 may comprise a first opening 116 for liquid discharge conduit 10 and a separate, smaller, second opening 132 (FIG. 1) for an electrical circuit 12 (FIG. 3). Again, referring to FIG. 1, the first opening 116 may be proximate perimeter 130 of the receptacle.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

It will be appreciated that although description of the invention has been presented with reference to two receptacle components 102, those of skill in the art will recognize that three or even more such components could be provided if desired. It is felt that for most installations, providing the receptacle in only two components sufficiently reduces bulk to enable convenient transport and assembly of multi-part sump pump bucket 100. For much larger sumps pumps and installations, a greater number of receptacle components 102 could be used.

The present invention is susceptible to modifications and variations which may be introduced thereto without departing from the inventive concepts. For example, the receptacle could be circular rather than octagonal as shown. Also, flanges 122 may be replaced by tabs (not shown). Both flanges 122 and tabs could project into the receptacle rather than outwardly therefrom, as shown. Cap 110 could engage the receptacle by engaging interior surfaces of the receptacle rather than outer surfaces, if desired. Cap 110 could use a fastener arrangement to engage the receptacle if desire. Receptacle components 102 could interfit or use frictional engagement to assemble to one another.

The various components of the multi-part sump pump bucket may be fabricated either in whole or alternatively, in part, by injection molding from a suitable plastic material. ABS plastic (acrylonitrile butadiene styrene) exemplifies a suitable plastic material.

While the present invention has been described in connection with what is considered the most practical and preferred embodiment, it is to be understood that the present invention is not to be limited to the disclosed arrangements but is intended to cover various arrangements which are included within the spirit and scope of the broadest possible interpretation of the appended claims so as to encompass all modifications and equivalent arrangements which are possible.

I claim:

1. A multi-part sump pump bucket for receiving a sump pump, the multi-part sump pump bucket consisting of a three part housing when not assembled, the three part housing including:

two identical receptacle components matable to one another to form a receptacle including a side wall and a floor, and a cap, wherein each one of the two identical receptacle components includes a side wall portion and a floor portion, the two identical receptacle components including a fastening arrangement for assembling the two identical receptacle components into the receptacle, at least the side wall of the receptacle has at least one aperture to enable ingress of liquid in the vicinity of the multi-part sump pump bucket to enter the receptacle, each one of the two identical receptacle components is configured to leave an uncovered gap between the two identical receptacle components at the floor when the two identical receptacle components are assembled to form the receptacle, whereby liquid can enter the receptacle from there beneath as well as through the at least one aperture of the side wall, the floor of the receptacle includes a raised portion for spacing the sump pump up off a portion of the floor, to facilitate water pickup by the sump pump, the fastening arrangement includes two flanges on opposed sides of each one of the two identical receptacle components, each said flange terminating a distance from a top of the side wall, to avoid interference with the cap when the cap is installed on the sidewall, each said flange includes at least one hole for receiving a fastener; wherein the cap has a downwardly projecting skirt configured to fit to the receptacle after the receptacle has been assembled from the two identical receptacle components, and at least a first opening extending entirely therethrough for enabling a liquid discharge conduit to extend from the sump pump in the receptacle to an exterior of the multi-part sump bucket.

2. The multi-part sump pump bucket of claim 1, wherein the raised portion of the floor is centered in the floor with respect to the side wall.

3. The multi-part sump pump bucket of claim 1, wherein the receptacle has an octagonal perimeter when assembled and viewed in plan.

4. The multi-part sump pump bucket of claim 1, wherein the cap comprises the first opening for the liquid discharge conduit and a separate, smaller, second opening for an electrical circuit.

* * * * *